US008656631B2

(12) United States Patent
Koesler et al.

(10) Patent No.: US 8,656,631 B2
(45) Date of Patent: Feb. 25, 2014

(54) FIBER OPTIC SHOTGUN SIGHT

(75) Inventors: Paul D. Koesler, New Hudson, MI (US); Robert W. Condra, New Hudson, MI (US); Edward J. Haney, Gaines, MI (US); Jeremiah Mauricio, Tecumseh, MI (US)

(73) Assignee: Trijicon, Inc., Wixom, MI (US)

( * ) Notice: Subject to any disclaimer, the term of this patent is extended or adjusted under 35 U.S.C. 154(b) by 105 days.

(21) Appl. No.: 13/285,537

(22) Filed: Oct. 31, 2011

(65) Prior Publication Data

US 2012/0180369 A1 Jul. 19, 2012

Related U.S. Application Data

(60) Provisional application No. 61/433,317, filed on Jan. 17, 2011.

(51) Int. Cl.
*F41G 1/00* (2006.01)

(52) U.S. Cl.
USPC ..... 42/132; 42/99

(58) Field of Classification Search
USPC ..... 42/132, 99
See application file for complete search history.

(56) References Cited

U.S. PATENT DOCUMENTS

| | | | | |
|---|---|---|---|---|
| 1,363,553 | A | 12/1920 | Barringer | |
| 1,922,302 | A | 8/1933 | King | |
| 2,488,541 | A | 11/1949 | Holme | |
| 2,706,335 | A * | 4/1955 | Munsey | 42/145 |
| 2,931,101 | A * | 4/1960 | Martin | 42/127 |
| 3,184,851 | A | 5/1965 | Simmons | |
| 3,439,970 | A | 4/1969 | Rickert | |
| 3,641,676 | A | 2/1972 | Knutsen et al. | |
| 3,698,091 | A | 10/1972 | Merrill et al. | |
| 3,700,339 | A | 10/1972 | Steck, III | |
| 3,777,380 | A | 12/1973 | Theodore | |
| 3,916,530 | A | 11/1975 | Tellie | |
| 4,015,354 | A | 4/1977 | Brouthers | |
| D247,856 | S | 5/1978 | Korzeniewski | |
| 4,366,625 | A | 1/1983 | Gehmann | |
| D273,217 | S | 3/1984 | Swenson | |
| D296,227 | S | 6/1988 | Novak | |
| D301,512 | S | 6/1989 | Novak | |
| D305,146 | S | 12/1989 | Novak | |

(Continued)

FOREIGN PATENT DOCUMENTS

| | | | |
|---|---|---|---|
| EP | 470016 | A1 | 2/1992 |
| WO | 2010034458 | A1 | 4/2010 |

OTHER PUBLICATIONS http://web.archive.org/web/20060524161152/http://www.10-8performance.com/; 10-8 Performance, Duty Ready 1911s; Hilton Yam; May 24, 2008; 2 Pages.

(Continued)

*Primary Examiner* — Samir Abdosh
(74) *Attorney, Agent, or Firm* — Harness, Dickey & Pierce, P.L.C.

(57) ABSTRACT

A sight assembly for a shotgun is provided and may include a housing. A light-collecting fiber may be supported by the housing and may extend along a longitudinal axis of the housing. A lens may be supported by the housing and may receive light from the fiber to display an aiming point. The lens may be spaced apart and separated from a distal end of the fiber by a predetermined distance.

39 Claims, 5 Drawing Sheets

(56) References Cited

U.S. PATENT DOCUMENTS

| | | | | | |
|---|---|---|---|---|---|
| D305,561 | S | | 1/1990 | Novak | |
| D315,776 | S | | 3/1991 | Novak | |
| 5,065,519 | A | * | 11/1991 | Bindon | 42/145 |
| 5,070,619 | A | | 12/1991 | Santiago | |
| 5,103,567 | A | * | 4/1992 | Loving | 42/119 |
| D352,087 | S | | 11/1994 | Stevens et al. | |
| 5,359,800 | A | | 11/1994 | Fisher et al. | |
| 5,373,657 | A | * | 12/1994 | Betz et al. | 42/111 |
| 5,426,882 | A | | 6/1995 | Dornaus | |
| 5,442,861 | A | | 8/1995 | Lorocco | |
| D363,334 | S | | 10/1995 | De Oliveira Masina | |
| 5,471,777 | A | | 12/1995 | McDonald | |
| RE35,347 | E | * | 10/1996 | Bindon | 42/145 |
| 5,638,604 | A | | 6/1997 | Lorocco | |
| D382,038 | S | | 8/1997 | Nigh | |
| D387,844 | S | | 12/1997 | Emerson | |
| 5,735,070 | A | * | 4/1998 | Vasquez et al. | 42/1.02 |
| D399,291 | S | | 10/1998 | Emerson | |
| D399,292 | S | | 10/1998 | Emerson | |
| 5,836,100 | A | | 11/1998 | Stover | |
| D403,734 | S | | 1/1999 | Kay | |
| 5,862,618 | A | | 1/1999 | Brown | |
| D406,630 | S | | 3/1999 | Emerson | |
| 5,878,503 | A | | 3/1999 | Howe et al. | |
| 5,878,521 | A | | 3/1999 | Warnock | |
| 5,887,352 | A | | 3/1999 | Kim | |
| 5,956,854 | A | | 9/1999 | Lorocco | |
| 5,965,854 | A | | 10/1999 | Umemura | |
| 6,014,830 | A | * | 1/2000 | Brown et al. | 42/145 |
| 6,016,608 | A | | 1/2000 | Lorocco | |
| 6,035,539 | A | | 3/2000 | Hollenbach et al. | |
| 6,058,615 | A | | 5/2000 | Uhlmann et al. | |
| 6,058,616 | A | | 5/2000 | Bubits | |
| 6,085,427 | A | | 7/2000 | Persson | |
| 6,122,833 | A | | 9/2000 | Lorocco | |
| D435,625 | S | | 12/2000 | Ling, Jr. | |
| D436,393 | S | | 1/2001 | Ling, Jr. | |
| 6,216,351 | B1 | * | 4/2001 | Flubacher et al. | 42/145 |
| 6,216,352 | B1 | | 4/2001 | Lorocco | |
| D443,016 | S | | 5/2001 | Nigh | |
| 6,233,836 | B1 | | 5/2001 | Uhlmann et al. | |
| D447,205 | S | | 8/2001 | Keng | |
| 6,279,976 | B1 | | 8/2001 | Ball | |
| 6,360,471 | B1 | | 3/2002 | Stein | |
| 6,360,472 | B1 | | 3/2002 | Lorocco | |
| 6,367,189 | B1 | | 4/2002 | Clay | |
| 6,421,946 | B1 | | 7/2002 | LoRocco | |
| 6,446,377 | B1 | | 9/2002 | Hollenbach et al. | |
| 6,571,504 | B2 | * | 6/2003 | Carlson | 42/132 |
| 6,604,315 | B1 | * | 8/2003 | Smith et al. | 42/112 |
| 6,622,413 | B1 | | 9/2003 | Bickett | |
| 6,640,482 | B2 | | 11/2003 | Carlson | |
| 6,711,846 | B1 | | 3/2004 | Nasef | |
| D492,747 | S | | 7/2004 | LoRocco | |
| 6,769,210 | B2 | | 8/2004 | Bubits | |
| 6,834,457 | B1 | | 12/2004 | Warren | |
| 6,860,056 | B2 | | 3/2005 | Howe | |
| D512,118 | S | | 11/2005 | Warren | |
| D512,760 | S | | 12/2005 | Warren | |
| D515,170 | S | | 2/2006 | Price | |
| D520,099 | S | | 5/2006 | Warren | |
| D520,592 | S | | 5/2006 | Warren | |
| D521,101 | S | | 5/2006 | Warren | |
| D521,591 | S | | 5/2006 | Warren | |
| D526,695 | S | | 8/2006 | Warren | |
| D527,068 | S | | 8/2006 | Warren | |
| D531,693 | S | | 11/2006 | Warren et al. | |
| D533,616 | S | | 12/2006 | Warren | |
| D533,617 | S | | 12/2006 | Warren | |
| D534,986 | S | | 1/2007 | Warren et al. | |
| D541,897 | S | | 5/2007 | Warren et al. | |
| D546,915 | S | | 7/2007 | Price | |
| 7,287,351 | B1 | | 10/2007 | Warren | |
| D560,744 | S | | 1/2008 | Warren et al. | |
| D565,144 | S | | 3/2008 | Price | |
| 7,451,566 | B1 | | 11/2008 | Price | |
| 7,458,180 | B2 | | 12/2008 | Liang | |
| 7,562,486 | B2 | | 7/2009 | LoRocco | |
| 7,565,762 | B2 | | 7/2009 | Lackey | |
| 7,627,976 | B1 | * | 12/2009 | Olson | 42/145 |
| D611,112 | S | | 3/2010 | Kay | |
| 7,676,137 | B2 | | 3/2010 | Schick et al. | |
| 7,886,475 | B2 | | 2/2011 | Dubois | |
| 7,905,044 | B2 | | 3/2011 | Clouser | |
| 7,908,783 | B2 | | 3/2011 | Howe et al. | |
| 8,037,634 | B2 | | 10/2011 | Price | |
| 8,132,352 | B2 | | 3/2012 | Lippard | |
| 8,189,967 | B1 | | 5/2012 | Olson | |
| 8,296,990 | B2 | | 10/2012 | Zukowski et al. | |
| 2002/0157298 | A1 | * | 10/2002 | Carlson | 42/132 |
| 2002/0166278 | A1 | * | 11/2002 | Carlson | 42/132 |
| 2004/0025398 | A1 | * | 2/2004 | Howe | 42/132 |
| 2006/0123687 | A1 | | 6/2006 | Howe et al. | |
| 2006/0207157 | A1 | | 9/2006 | Keng | |
| 2007/0240354 | A1 | | 10/2007 | Warren | |
| 2008/0092424 | A1 | | 4/2008 | Keng | |
| 2009/0013581 | A1 | * | 1/2009 | LoRocco | 42/132 |
| 2009/0126251 | A1 | | 5/2009 | Howe et al. | |
| 2010/0088944 | A1 | | 4/2010 | Callihan | |
| 2010/0170138 | A1 | | 7/2010 | Zukowski | |
| 2011/0067286 | A1 | | 3/2011 | Price | |
| 2011/0107650 | A1 | | 5/2011 | Howe et al. | |
| 2011/0197491 | A1 | * | 8/2011 | McCann | 42/132 |
| 2011/0225867 | A1 | | 9/2011 | Moore et al. | |
| 2011/0314721 | A1 | | 12/2011 | Lamb | |
| 2012/0144721 | A1 | | 6/2012 | Glimpse et al. | |
| 2012/0151817 | A1 | | 6/2012 | Howe et al. | |
| 2012/0198750 | A1 | | 8/2012 | Mansfield | |
| 2013/0061511 | A1 | | 3/2013 | Strayer | |
| 2013/0180156 | A1 | | 7/2013 | Shebaro | |

OTHER PUBLICATIONS

Patent Examination Report No. 1 regarding Patent Application No. 2011253529, dated Mar. 21, 2013.

Patent Examination Report No. 2 regarding Patent Application No. 2011253529, dated Aug. 5, 2013.

Final Office Action in U.S. Appl. No. 13/222,740, mailed Jun. 25, 2013.

Non-Final Office Action in U.S. Appl. No. 13/222,740, mailed Mar. 27, 2013.

* cited by examiner

FIBER OPTIC SHOTGUN SIGHT

CROSS-REFERENCE TO RELATED APPLICATIONS

This application claims the benefit of U.S. Provisional Application No. 61/433,317, filed on Jan. 17, 2011. The disclosure of the above application is incorporated herein by reference in its entirety.

FIELD

The present disclosure relates to optical sights and more particularly to an optical sight for use with a shotgun.

BACKGROUND

This section provides background information related to the present disclosure which is not necessarily prior art.

Sight mechanisms are conventionally used with shotguns to aid a shooter in properly aligning a barrel of the shotgun with a target. For example, conventional shotguns typically include an aiming bead disposed at a distal end thereof that allows a shooter to properly align the barrel of the shotgun with a target by aligning the aiming bead with the target. Such aiming beads are typically fixedly attached at the distal end of the shotgun and extend upwardly from a top surface of the barrel. Further, aiming beads are typically installed on a barrel of a shotgun by a shotgun manufacturer and are often integrally formed with, or are permanently affixed to, the barrel.

Aftermarket sight mechanisms may be used in conjunction with a shotgun to allow a shooter to customize the shotgun. Such aftermarket sight mechanisms must be fitted to the barrel of the shotgun and, as a result, often require modifications to the barrel. Barrel modifications are generally time consuming and costly, given that such modifications often require consultation with or performance by a gunsmith. For example, conventional aftermarket sights are typically placed in an area of an aiming bead. Because aiming beads may be formed integrally with, or are permanently affixed to, the barrel of the shotgun, removal of the aiming bead often requires removal of material from the barrel itself.

In addition to the cost and complexity associated with mounting an aftermarket sight mechanism to a shotgun, many conventional aftermarket sight mechanisms fail to provide an illuminated aiming point. As such, conventional aftermarket sight mechanisms are difficult to use in low-light conditions.

SUMMARY

This section provides a general summary of the disclosure, and is not a comprehensive disclosure of its full scope or all of its features.

A sight assembly for a shotgun is provided and may include a housing. A light-collecting fiber may be supported by the housing and may extend along a longitudinal axis of the housing. A lens may be supported by the housing and may receive light from the fiber to display an aiming point. The lens may be spaced apart and separated from a distal end of the fiber by a predetermined distance.

In another configuration, a sight assembly for a shotgun is provided and may include a housing. A fiber may be disposed within the housing, may extend along a longitudinal axis of the housing, and may generate an aiming point at a distal end of the housing. A sleeve may be attached to the fiber and may engage the housing to position the sleeve and the fiber relative to the housing.

In another configuration, a sight assembly for a shotgun is provided and may include a housing. A fiber may be supported by the housing and may extend along a longitudinal axis of the housing. A sleeve may be attached to the fiber and may position the fiber relative to the housing. The sleeve may be attached to the fiber via an adhesive having a lower refractive index than the fiber.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
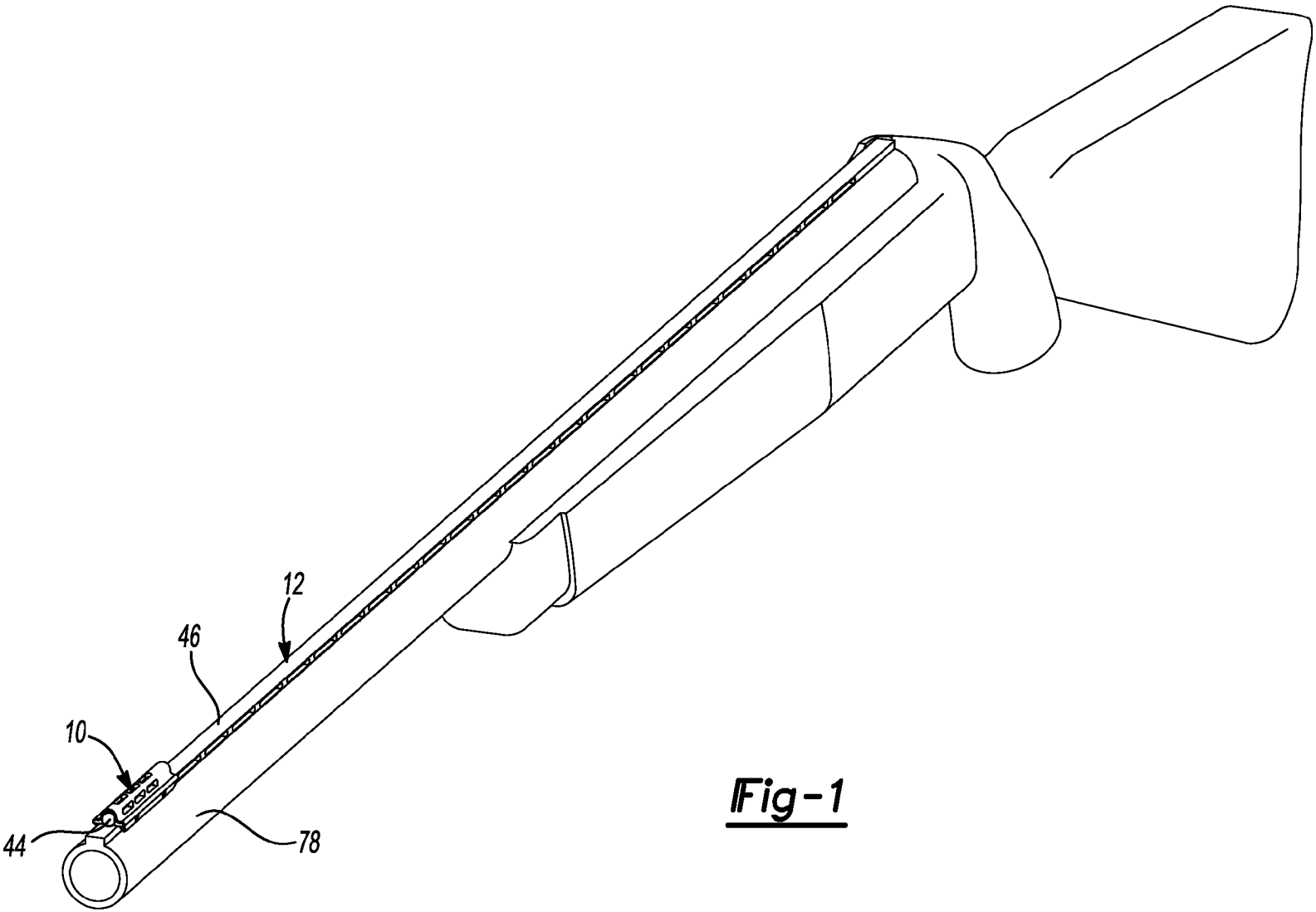
FIG. 1 is a perspective view of a shotgun incorporating an optical sight in accordance with the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to the figures, an optical sight 10 is provided for use in conjunction with a shotgun 12. The optical sight 10 may be releasably secured to the shotgun 12 and may include a housing 14 and an illumination device 16. The housing 14 may position the illumination device 16 relative to the shotgun 12 to aid a shooter in properly aligning the shotgun 12 with a target (not shown). While the optical sight 10 is described and shown as being used in conjunction with a shotgun 12, the optical sight 10 could be used in conjunction with any firearm for use in properly aligning the firearm with a target.

With particular reference to FIGS. 2-5, the housing 14 may include a main body 18 having a pair of depending flanges 20, a bottom surface 22, and an arcuate surface 24 defining the overall shape of the housing 14. The main body 18 may also include a series of windows or openings 26 extending generally through the main body 18 at the arcuate surface 24. The openings 26 may include a substantially oval shape and may extend completely through the main body 18 such that the openings 26 are in communication with an interior 28 of the main body 18. While the openings 26 are shown and described as including a substantially oval shape, the openings 26 could include virtually any shape to permit communication between an area generally outside of the arcuate surface 24 and the interior 28 of the main body 18 to permit ambient light to enter the interior 28 of the housing 14 via the openings 26.

Figure 5:
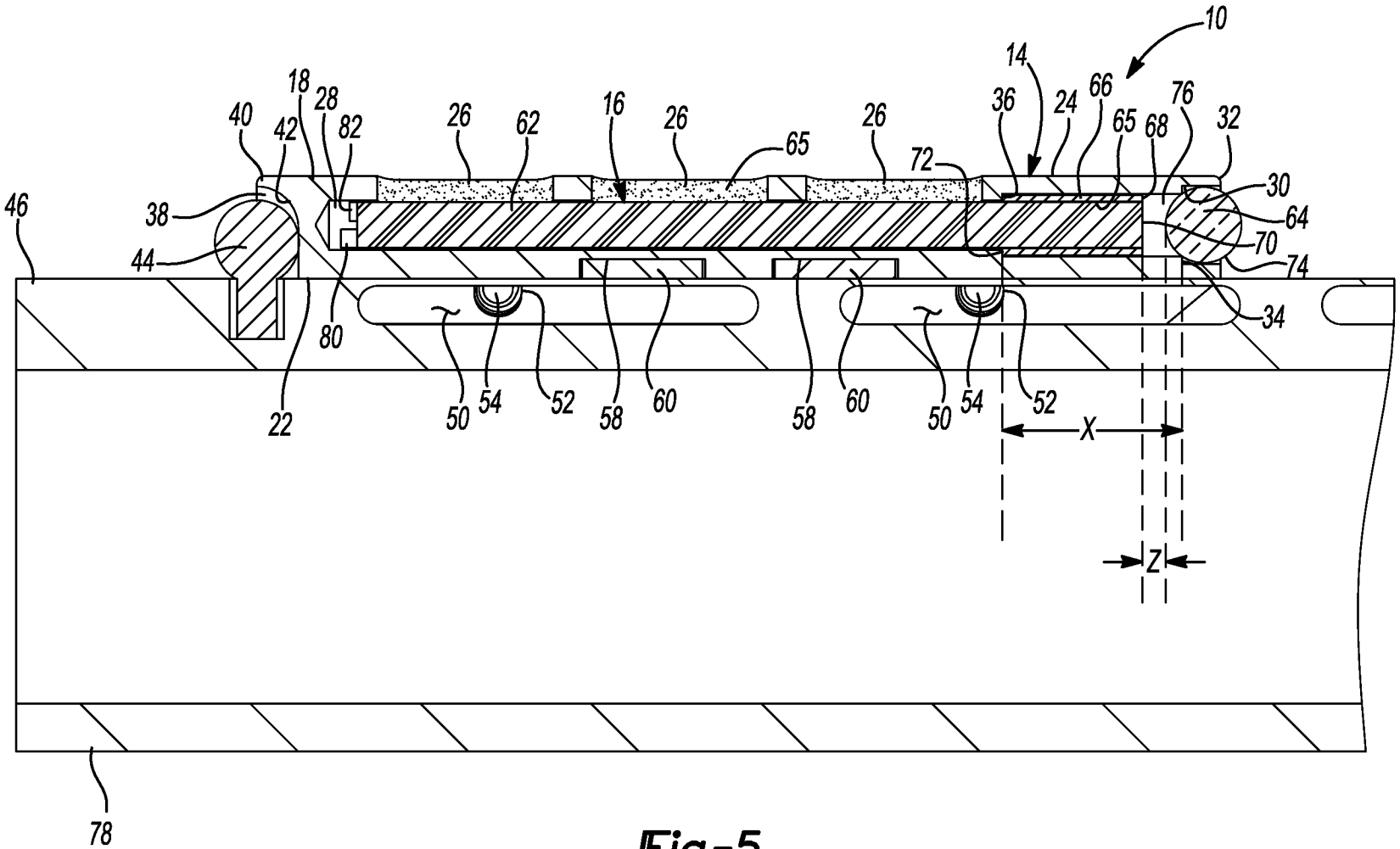
FIG. 5 is a partial cross-sectional view taken along the line 5-5 of FIG. 3.

The main body 18 may additionally include an opening 30 disposed at a first end 32 of the main body 18. The opening 30 may include a substantially circular shape and may define a stop 34 for interaction with a portion of the illumination device 16, as will be described in greater detail below. The main body 18 may also include a stop 36 that is spaced apart and separated from the stop 34 by a predetermined distance (X; FIG. 5). The stop 36 may interact with a portion of the illumination device 16 to position the illumination device 16 relative to the main body 18 of the housing 14.

A pocket 38 may be disposed at a second end 40 of the main body 18 and may extend generally into the main body 18 towards the first end 32. The pocket 38 may be formed into the main body 18 such that the pocket 38 extends at least partially through the bottom surface 22 of the housing 14 (FIG. 2) and may include a generally arcuate inner surface 42 at a top portion thereof. While the pocket 38 is described as including a substantially arcuate inner surface 42, the pocket 38 could include virtually any shape that accommodates an existing aiming bead 44 of the shotgun 12.

Once the housing 14 is installed on the shotgun 12, the existing aiming bead 44 may be at least partially received within the pocket 38 to allow the housing 14 to be attached to the shotgun 12 without having to remove the existing aiming bead 44. Furthermore, allowing the aiming bead 44 to engage at least a portion of the pocket 38 at the arcuate inner surface 42 allows the existing aiming bead 44 to properly position the housing 14 relative to the shotgun 12, and allows the existing aiming bead 44 to react recoil accelerations imparted upon the sight 10 during firing. Properly positioning the housing 14 relative to the shotgun 12 allows the housing 14 to properly position the illumination device 16 relative to the shotgun 12, thereby improving the effectiveness and reliability of the optical sight 10.

Figure 7:
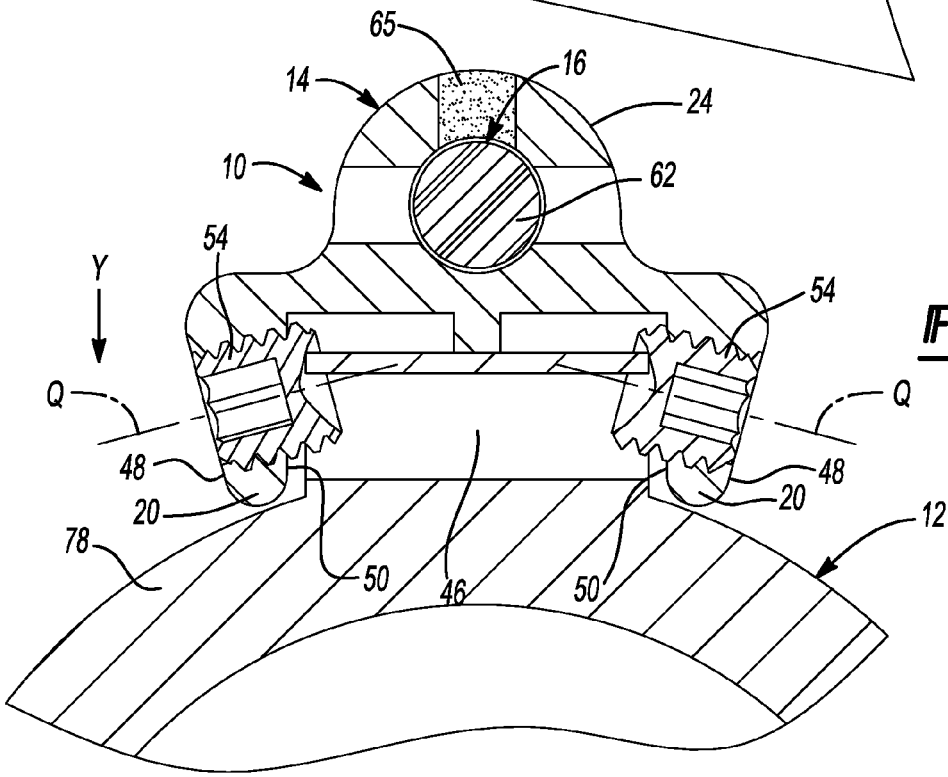
FIG. 7 is a cross-sectional view of the optical sight of FIG. 1 taken along line 7-7 of FIG. 4.

The flanges 20 may extend generally away from the main body 18 of the housing 14 and may be positioned relative to the main body 18 such that the flanges 20 flank a barrel rib 46 of the shotgun 12 when installed. The flanges 20 may include an outer surface 48, an inner surface 50, and a series of threaded bores 52. The inner surface 50 may be formed substantially perpendicular to the bottom surface 22 of the housing 14 while the outer surface 48 may be formed at an angle relative to the bottom surface 22 of the housing 14. In one configuration, the angle is less than ninety degrees (90°). Regardless of the angle of the outer surface(s) 48, the threaded bores 52 extend at an angle and generally towards the bottom surface 22 of the housing 14. For example, the threaded bores 52 may extend along a hypothetical axis (Q; FIG. 7), whereby the axes (Q) associated with bores 52 disposed on opposite sides of the barrel rib 46 are intersecting.

The threaded bores 52 may respectively and threadably receive set screws 54 that are movable between a retracted position and an extended position. The set screws 54 are in the retracted position when the set screws 54 are spaced apart and separated from the barrel rib 46 and are in the extended or engaged position when the set screws 54 are rotated sufficiently relative to the threaded bores 52 such that the set screws 54 contact the barrel rib 46. Because the threaded bores 52 and, thus, the set screws 54 are positioned at an angle relative to the bottom surface 22 of the housing 14, rotating the set screws 54 into the engaged position such that the set screws 54 contact the barrel rib 46 causes a downward force to be applied on the housing 14 in a (Y) direction shown in FIG. 7. Applying a force on the housing 14 in the (Y) direction causes the housing 14 to move into closer engagement with the barrel rib 46, thereby securably attaching the housing 14 to the barrel rib 46 and restricting relative movement between the housing 14 and the barrel rib 46.

The bottom surface 22 of the housing 14 generally opposes a top surface 56 of the barrel rib 46 when the housing 14 is attached to the barrel rib 46. The bottom surface 22 may include one or more recesses 58 formed therein for respectively receiving a magnet 60 in each recess. The magnets 60 may be fixedly attached to the main body 18 of the housing 14 within the recesses 58 by a suitable epoxy, for example, and may magnetically engage the top surface 56 of the barrel rib 46 to retain the housing 14 in contact with the barrel rib 46 when the housing 14 is attached to the shotgun 12.

Figure 2:
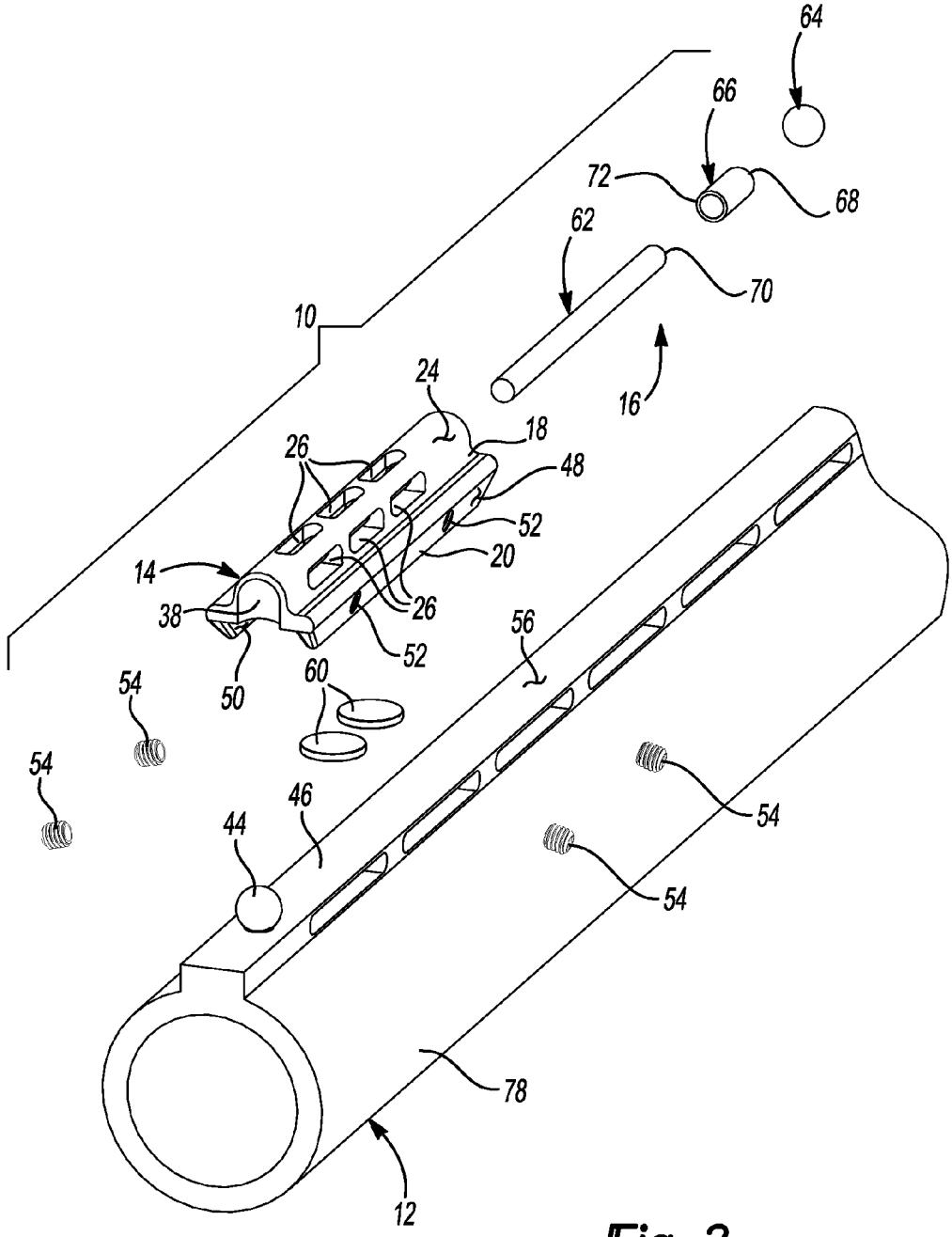
FIG. 2 is an exploded view of the optical sight of FIG. 1 and a partial perspective view of the shotgun.
Figure 3:
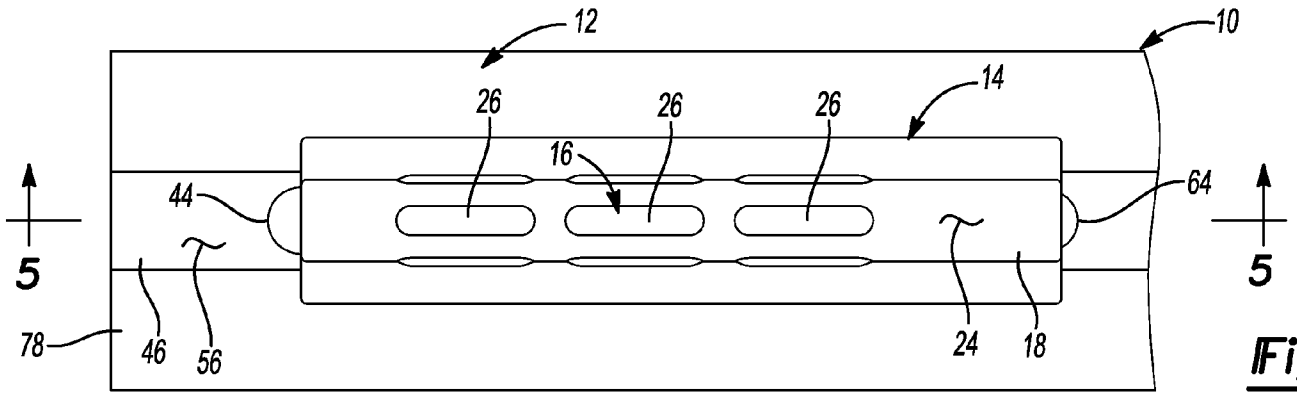
FIG. 3 is a top view of the optical sight of FIG. 1 shown installed on a shotgun.
Figure 4:
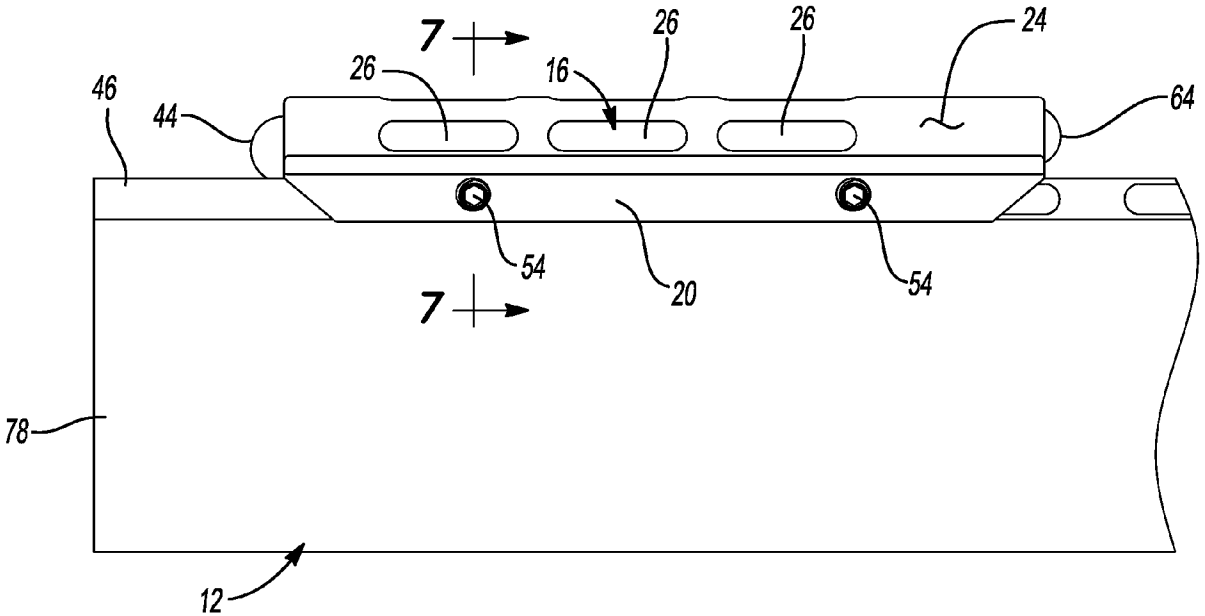
FIG. 4 is a side view of the optical sight of FIG. 1 shown installed on a shotgun.

With particular reference to FIGS. 2 and 5, the illumination device 16 is shown to include a fiber optic 62, a lens 64, and a sleeve 66. The fiber optic 62 may be a clad fiber optic that is heat and chemical resistant to prevent the fiber optic 62 from being damaged by environmental conditions, gun cleaning solvents, or lubricants at the openings 26 of the housing 14. The fiber optic 62 may be received generally within the interior 28 of the housing 14 and may be exposed at each of the openings 26 to allow the fiber optic 62 to receive ambient light at each opening 26.

The lens 64 may be received generally within the opening 30 and may engage the stop 34 to position the lens 64 relative to the housing 14. In one configuration, the lens 64 may be a sapphire ball lens that engages the stop 34 to position the ball lens 64 relative to the opening 30 and, thus, relative to the housing 14. As shown in FIG. 5, the ball lens 64 may at least partially extend from the first end 32 of the housing 14 and may be at least partially received within the housing 14.

The sleeve 66 may be fixedly attached to one end of the fiber optic 62 such that a first end 68 of the sleeve 66 is substantially coplanar and flush with a distal end 70 of the fiber optic 62. Positioning the first end 68 of the sleeve 66 relative to the distal end 70 of the fiber optic 62 such that the ends 68, 70 are substantially flush allows the sleeve 66 to properly position the fiber optic 62 relative to the housing 14 by allowing the sleeve 66 to contact the housing 14 at stop 36. Specifically, positioning the first end 68 of the sleeve 66 relative to the distal end 70 of the fiber optic 62 allows a second end 72 of the sleeve 66 to contact the stop 36, thereby positioning the sleeve 66 and, thus, the fiber optic 62, relative to the housing 14.

Positioning the sleeve 66 and, thus, the fiber optic 62, relative to the housing 14 by engaging the sleeve 66 with the stop 36 allows the distal end 70 of the fiber optic 62 to be consistently and reliably positioned relative to the lens 64. Consistently and reliably positioning the distal end 70 of the fiber optic 62 relative to the lens 64 establishes a predetermined distance Z (FIG. 5) between the distal end 70 of the fiber optic 62 and the lens 64 to reliably and repeatably create an aiming point 74 via the lens 64 with light from the fiber optic 62. The distance (Z) defines a predetermined gap 76 located between the distal end 70 of the fiber optic 62 and the lens 64. Light from the fiber optic 62 is received by the lens 64 to allow the lens 64 to generate the aiming point 74 with a consistent size, shape and illumination.

The sleeve 66 may be attached to the fiber optic 62 such that the sleeve 66 generally surrounds an outer diameter of the fiber optic 62. In one configuration, the sleeve 66 is attached to the fiber optic 62 via an adhesive 65 having a mismatched refractive index. Specifically, the adhesive 65 may have a different refractive index than does the fiber optic 62 to minimize light loss from the fiber optic 62 at the sleeve 66. While the adhesive 65 is described as being associated with the sleeve 66, the adhesive 65 could be used to fill one or more of the openings 26 of the housing 14 to concurrently permit light to enter the housing via the openings 26 and protect the fiber optic 62. As described above, the adhesive 65 includes a different refractive index than the fiber optic 62 and therefore minimizes light loss from the fiber optic 62 not only at the sleeve 66 but also at each opening 26.

Figure 6:
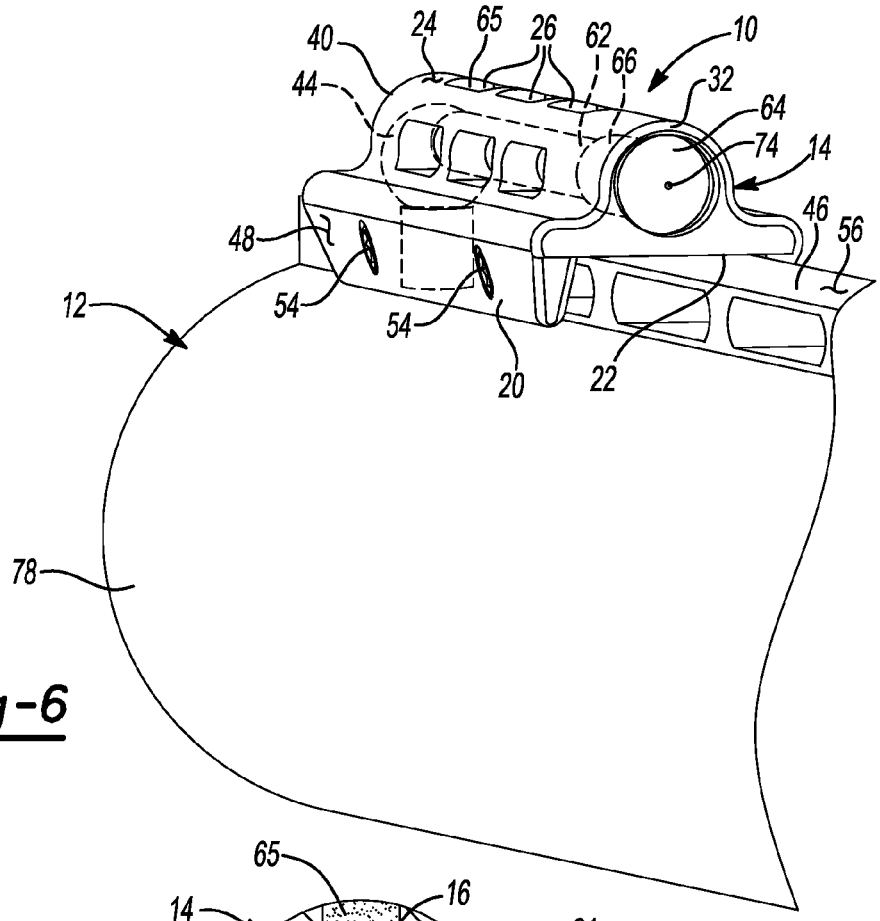
FIG. 6 is a perspective view of the optical sight of FIG. 1 shown installed on a shotgun.

With particular reference to FIGS. 5-7, operation of the optical sight 10 will be described in detail. The optical sight 10 may be positioned relative to the barrel rib 46 of the shotgun 12 by first engaging the magnets 60 with the top surface 56 of the barrel rib 46. The magnets 60 maintain engagement between the housing 14 and the barrel rib 46 during and after installation. Following attachment of the magnets 60 to the barrel rib 46, the housing 14 may be slid along the barrel rib 46 until the aiming bead 44 is received within the pocket 38 of the housing 14. Specifically, the housing 14 may be slid relative to the barrel rib 46 until the aiming bead 44 contacts the arcuate inner surface 42 of the pocket 38. The housing 14 may be additionally secured to the barrel rib 46 by applying a rotational force to each set screw 54 to move each set screw 54 from the retracted position to the engaged position to allow the set screw 54 to contact the barrel rib 46 and move the housing 14 in the (Y) direction (FIG. 7) and towards the top surface 56 of the barrel rib 46. Specifically, each set screw 54 may be adjusted until a desired position of the housing 14 is achieved in a direction substantially perpendicular to the (Y)_direction. Once the position of the housing 14 is properly positioned relative to the barrel rib 46, each set screw 54 may be tightened and moved further into the engaged position to restrict movement of the housing 14 relative to the barrel rib 46. Once the set screws 54 are in the engaged position, the housing 14 is properly positioned relative to the barrel rib 46 and, thus, the shotgun 12.

During operation, ambient light is received at the openings 26 and is supplied to the fiber optic 62. The fiber optic 62 receives the light from the openings 26 and causes the light to be directed generally towards the lens 64. The lens 64 focuses the light received from the fiber optic 62 to provide the illuminated aiming point 74 at the lens 64. The lens 64 may additionally magnify the light received from the fiber optic 62 to generate the illuminated aiming point 74 of the desired shape, size, and illumination. The lens 64 may be a substantially clear lens that transmits the color of the light received from the fiber optic 62 such that the illuminating aiming point 74 includes substantially the same color as the fiber optic 62. Because the housing 14 is properly positioned and maintained in a fixed position relative to the barrel rib 46, the illuminated aiming point 74 may be used to properly align a barrel 78 of the shotgun 12 relative to a target (not shown).

While the optical sight 10 is described and shown as including an illumination device 16 having a fiber optic 62 that supplies light to a lens 64 for generating an illuminating aiming point 74, the optical sight 10 may additionally include a secondary light source to supply light to the lens 64 when ambient light conditions are low. For example, the illumination device 16 may include a tritium lamp 80 and/or a light-emitting device (LED) 82 that supply light to the lens 64 via the fiber optic 62 in low-ambient light conditions, or that supply light directly to the lens 64 when placed inside the end of the fiber optic 62 closest to the lens 64. The tritium lamp 80 and LED 82 may be used in combination with the fiber optic 62 or, alternatively, may be individually used with the fiber optic 62 such that the fiber optic 62 is associated with one of the tritium lamp 80 and the LED 82.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sight assembly for a shotgun, the sight assembly comprising:

a housing;

a light-collecting fiber supported by said housing and extending along a longitudinal axis of said housing; and a sapphire ball lens supported by said housing and receiving light from said fiber to display an aiming point, said lens opposing and being spaced apart from a distal end of said fiber by a predetermined distance.

2. The sight assembly of claim 1, further comprising a sleeve received proximate to said distal end of said fiber to position said fiber relative to said housing.

3. The sight assembly of claim 2, wherein said housing includes a stop operable to engage said sleeve to position said sleeve relative to said housing.

4. The sight assembly of claim 1, wherein said fiber is a clad fiber optic.

5. The sight assembly of claim 1, wherein said housing includes at least one opening operable to expose said fiber along a length of said fiber.

6. The sight assembly of claim 1, wherein said housing includes a clearance operable to receive a bead of the shotgun, said clearance being disposed at an opposite end of said housing than said lens.

7. The sight assembly of claim 1, wherein said housing includes a pair of flanges depending from a bottom surface of said housing, said pair of flanges including an outer surface formed at an angle less than ninety degrees (90°) relative to said bottom surface of said housing.

8. The sight assembly of claim 1, wherein said housing includes at least two set screws operable to engage a barrel of the shotgun.

9. The sight assembly of claim 8, wherein said at least two set screws are movable from a disengaged position removed from contact with the barrel of the shotgun to an engaged position contacting the barrel of the shotgun, said at least two set screws moving between said disengaged position and said engaged position along an axis formed at an angle relative to a bottom surface of said housing.

10. The sight assembly of claim 1, wherein said housing includes at least one magnet disposed at a bottom surface thereof, said at least one magnet operable to selectively attach said housing to a barrel of the shotgun.

11. The sight assembly of claim 1, wherein said ball lens extends at least partially from a distal end of said housing.

12. A sight assembly for a shotgun, the sight assembly comprising:

a housing;

a fiber disposed within said housing and extending along a longitudinal axis of said housing, said fiber operable to generate an aiming point at a distal end of said housing; and a sleeve attached to said fiber and operable to engage said housing to position said sleeve and said fiber relative to said housing; and a ball lens disposed at least partially within said housing and receiving light from said fiber to display said aiming point.

13. The sight assembly of claim 12, wherein said ball lens extends from said housing.

14. The sight assembly of claim 12, wherein said sleeve positions said fiber relative to said ball lens such that a predetermined gap extends between a distal end of said fiber and said ball lens.

15. The sight assembly of claim 12, wherein said ball lens is a sapphire ball lens.

16. The sight assembly of claim 12, wherein said sleeve is attached to said fiber via an adhesive.

17. The sight assembly of claim 12, wherein said fiber is a clad fiber optic.

18. The sight assembly of claim 12, wherein said sleeve is attached to said fiber proximate to a distal end of said fiber.

19. The sight assembly of claim 12, wherein said housing includes a stop operable to engage said sleeve to position said sleeve and said fiber relative to said housing.

20. The sight assembly of claim 12, wherein said housing includes at least one opening operable to expose said fiber along a length of said fiber.

21. The sight assembly of claim 12, wherein said housing includes a clearance operable to receive a bead of the shotgun, said clearance disposed at an opposite end of said housing than said distal end.

22. The sight assembly of claim 12, wherein said housing includes a pair of flanges depending from a bottom surface of said housing, said pair of flanges having an outer surface formed at an angle less than ninety degrees (90°) relative to said bottom surface of said housing.

23. The sight assembly of claim 12, wherein said housing includes at least two set screws operable to engage a barrel of the shotgun.

24. The sight assembly of claim 23, wherein said at least two set screws are movable from a disengaged position removed from contact with the barrel of the shotgun to an engaged position contacting the barrel of the shotgun, said at least two set screws moving between said disengaged position and said engaged position along an axis formed at an angle relative to a bottom surface of said housing.

25. The sight assembly of claim 12, wherein said housing includes at least one magnet disposed at a bottom surface thereof, said at least one magnet operable to selectively attach said housing to a barrel of the shotgun.

26. A sight assembly for a shotgun, the sight assembly comprising:

a housing including a clearance operable to receive a bead of the shotgun;

a light-collecting fiber supported by said housing and extending along a longitudinal axis of said housing; and a lens supported by said housing and receiving light from said fiber to display an aiming point, said lens being spaced apart and separated from a distal end of said fiber by a predetermined distance and disposed at an opposite end of said housing than said clearance.

27. The sight assembly of claim 26, further comprising a sleeve received proximate to said distal end of said fiber to position said fiber relative to said housing.

28. The sight assembly of claim 27, wherein said housing includes a stop operable to engage said sleeve to position said sleeve relative to said housing.

29. The sight assembly of claim 26, wherein said housing includes at least one opening operable to expose said fiber along a length of said fiber.

30. The sight assembly of claim 26, wherein said housing includes a pair of flanges depending from a bottom surface of said housing, said pair of flanges including an outer surface formed at an angle less than ninety degrees (90°) relative to said bottom surface of said housing.

31. The sight assembly of claim 26, wherein said housing includes at least two set screws operable to engage a barrel of the shotgun.

32. The sight assembly of claim 31, wherein said at least two set screws are movable from a disengaged position removed from contact with the barrel of the shotgun to an engaged position contacting the barrel of the shotgun, said at least two set screws moving between said disengaged position and said engaged position along an axis formed at an angle relative to a bottom surface of said housing.

33. The sight assembly of claim 26, wherein said housing includes at least one magnet disposed at a bottom surface thereof, said at least one magnet operable to selectively attach said housing to a barrel of the shotgun.

34. A sight assembly for a shotgun, the sight assembly comprising:

a housing including at least two set screws operable to engage a barrel of the shotgun, said at least two set screws movable from a disengaged position removed from contact with the barrel of the shotgun to an engaged position contacting the barrel of the shotgun and moving between said disengaged position and said engaged position along an axis formed at an angle relative to a bottom surface of said housing;

a light-collecting fiber supported by said housing and extending along a longitudinal axis of said housing;

a lens supported by said housing and receiving light from said fiber to display an aiming point, said lens being spaced apart and separated from a distal end of said fiber by a predetermined distance.

35. The sight assembly of claim 34, further comprising a sleeve received proximate to said distal end of said fiber to position said fiber relative to said housing.

36. The sight assembly of claim 35, wherein said housing includes a stop operable to engage said sleeve to position said sleeve relative to said housing.

37. The sight assembly of claim 34, wherein said housing includes at least one opening operable to expose said fiber along a length of said fiber.

38. The sight assembly of claim 34, wherein said housing includes a pair of flanges depending from said bottom surface of said housing, said pair of flanges including an outer surface formed at an angle less than ninety degrees (90°) relative to said bottom surface of said housing.

39. The sight assembly of claim 34, wherein said housing includes at least one magnet disposed at said bottom surface of said housing, said at least one magnet operable to selectively attach said housing to the barrel of the shotgun.

* * * * *